US006471726B2

(12) United States Patent
Wang

(10) Patent No.: US 6,471,726 B2
(45) Date of Patent: Oct. 29, 2002

(54) ERGONOMIC PILLOW

(75) Inventor: Wei-Kuan Wang, Taipei Hsien (TW)

(73) Assignee: Seda Chemical Products Co., Ltd., Taipei Hsien (TW)

( * ) Notice: Subject to any disclaimer, the term of this patent is extended or adjusted under 35 U.S.C. 154(b) by 0 days.

(21) Appl. No.: 10/026,645

(22) Filed: Dec. 27, 2001

(65) Prior Publication Data

US 2002/0138907 A1 Oct. 3, 2002

(30) Foreign Application Priority Data

Mar. 30, 2001 (TW) ..... 90204988 U

(51) Int. Cl.[7] ..... A47G 9/10
(52) U.S. Cl. ..... 636/636; 5/645
(58) Field of Search ..... 5/636, 637, 639, 5/645

(56) References Cited

U.S. PATENT DOCUMENTS 3,829,917 A * 8/1974 De Laittre et al. ..... 5/636
4,218,792 A * 8/1980 Kogan ..... 297/391
4,832,007 A * 5/1989 Davis et al. ..... 250/580
5,519,907 A * 5/1996 Poths ..... 5/636
5,533,218 A * 7/1996 Fahy ..... 5/421
5,682,633 A * 11/1997 Davis ..... 5/636

* cited by examiner

*Primary Examiner*—Michael F. Trettel
(74) *Attorney, Agent, or Firm*—Bacon & Thomas, PLLC

(57) ABSTRACT

An ergonomic pillow comprises a body including an inclined surface on either side, an arcuate central recess, and a slope near either side extended from the inclined surface to the recess so that either slope has the highest elevation on a top surface of the body; a front lengthwise projection member having a front slant extended from a bottom of the body adjacent to the recess; first and second cavities on the bottom of the body adjacent to either side and disposed corresponding to either slope; and an elongate third cavity at an underside of the projection member having the same orientation as the projection member. The pillow appropriately support face, ear, spine and shoulder for relaxing head and spine of a user in face-up or side sleeping.

6 Claims, 5 Drawing Sheets

ERGONOMIC PILLOW

FIELD OF THE INVENTION

The present invention relates to a pillow and more particularly to an ergonomic pillow.

BACKGROUND OF THE INVENTION

More and more people engage in bustling life as time evolves. It is found that many people use computers in their daily work. Also, some people like to play video games. Moreover, many people work on desks all day long. In addition, work pressure is large and exercise time is less for many people. Further, one common problem for office-work persons is strain or discomfort to their spine due to prolonged improper form of sitting. To the worse, such may lead to chronic disease in other parts of body. Conventionally, people like to walk or jog as means of exercise. However, such exercise can only train the body. As to relaxation, it is not effective. To the worse, it may cause further fatigue. For solving above problem, an ergonomic pillow, characterized by a smooth contact between head and pillow, has been developed for effectively relaxing head and spine in sleeping. Typically, almost all commercially available pillows are disadvantageous for complex components or recess on top surface of pillow not properly designed (i.e., not ergonomic). Hence, such recess cannot effectively relax head and spine in sleeping. To the worse, head and/or spine may be hurt.

Thus, it is desirable to provide an ergonomic pillow which is capable of effectively relaxing head and spine in sleeping in order to overcome the above drawbacks of prior art.

SUMMARY OF THE INVENTION

It is therefore an object of the present invention to provide an ergonomic pillow for eliminating problems associated with prior art such as complex components, not ergonomically designed, ineffective, and even hurting head and/or spine. By utilizing this pillow, it is possible of effectively relaxing head and spine in sleeping for obtaining a good sleep.

In one aspect of the present invention, an ergonomic pillow comprises a body including an inclined surface on either side, an arcuate central recess, and a slope near either side extended from the inclined surface to the recess so that either slope has the highest elevation on a top surface of the case; a front lengthwise projection member extended from a bottom of the body adjacent to the recess, the projection member having a front slant; first and second cavities on the bottom of the body adjacent to either side and disposed corresponding to either slope; and an elongate third cavity at an underside of the projection member having the same orientation as the projection member. In face-up sleeping, head of user is placed on the recess and spine thereof engages the front slant of projection member. Hence, the head and the spine of user can be appropriately supported. Also, a degree of comfort is provided to the head and the spine of user. As to side sleeping, one ear of user may press on slope at right or left side so that face, either ear, spine, and either shoulder can be appropriately supported for effectively relaxing head and spine of user.

In another aspect of the present invention, the ergonomic pillow further comprises a plurality of parallel lengthwise grooves extended from one side to the other side on a top of the body for increasing ventilation and providing a degree of comfort to head of user.

The above and other objects, features and advantages of the present invention will become apparent from the following detailed description taken with the accompanying drawings.

DETAILED DESCRIPTION OF THE PREFERRED EMBODIMENTS

In recent years, ever increasing numbers of people engage in bustling life. In addition, work pressure is large for many people. Further, one common problem for office-work persons is strain or discomfort to their spine due to prolonged improper form of sitting. Hence, an ergonomic pillow, characterized by a well contact between head and pillow, is desirable for effectively relaxing head and spine in sleeping. An ergonomic pillow of the invention is directed to and is devised by taking advantage of such consideration.

Referring to FIGS. 1, 2, 4, and 5 there is shown a first preferred embodiment of ergonomic pillow constructed in accordance with the invention comprising a body 10 having a good ventilation effect, and inclined surface on either side, an arcuate central recess 11, a slope 111 near either side extended from inclined surface to arcuate central recess 11 (i.e., slope 111 having the highest elevation on top surface of pillow) so that head of user may place on arcuate central recess 11 in sleeping. In other words, the head of user can be appropriately positioned at and supported on arcuate central recess 11. When user rotates his or her body and face to either right or left side, one ear of user may press on slope 111 at right or left side so that face and either ear of user can be appropriately supported by body 10.

Figure 1:
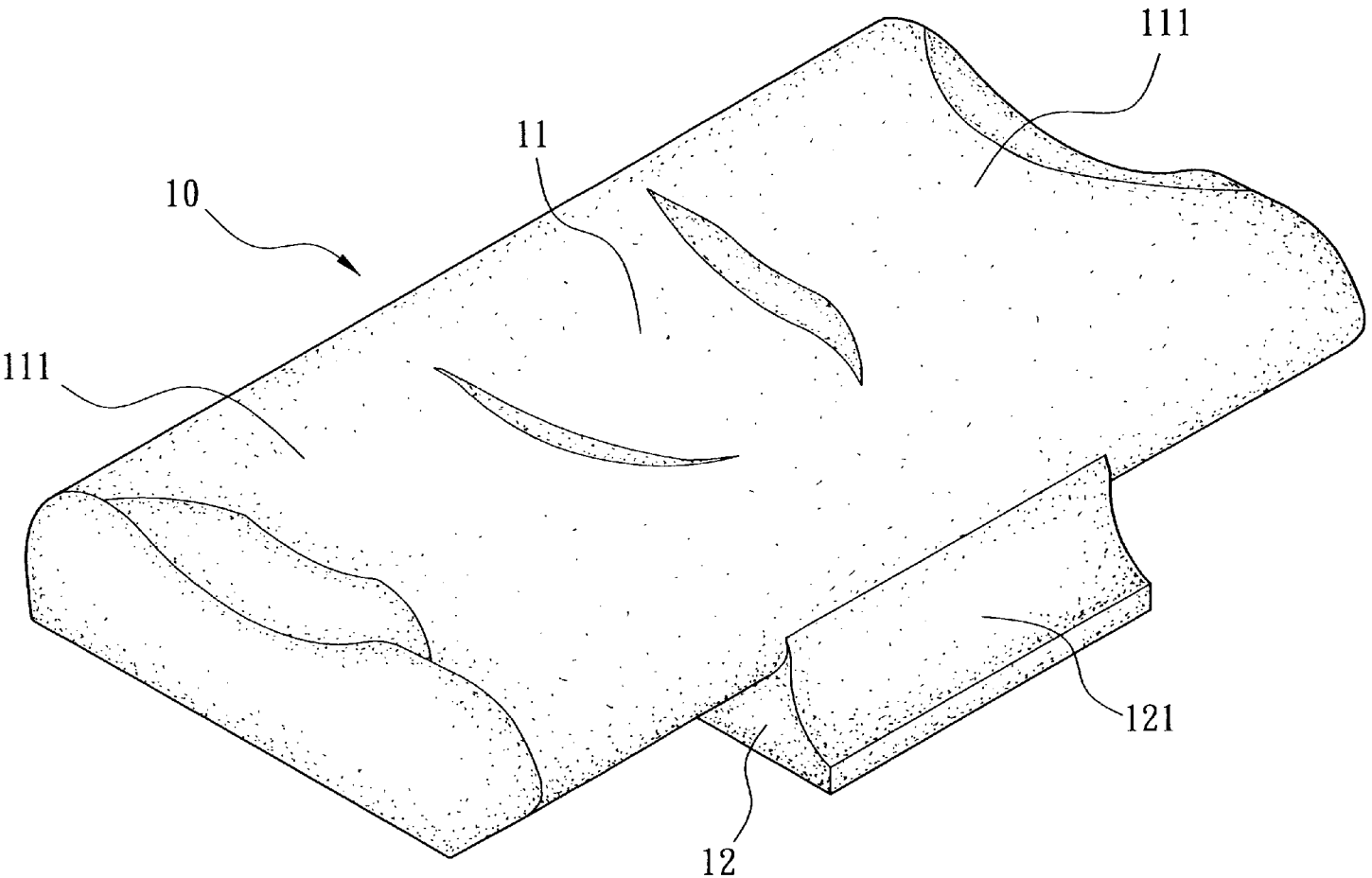
FIG. 1 is a top perspective view of a first preferred embodiment of ergonomic pillow according to the invention.
Figure 2:
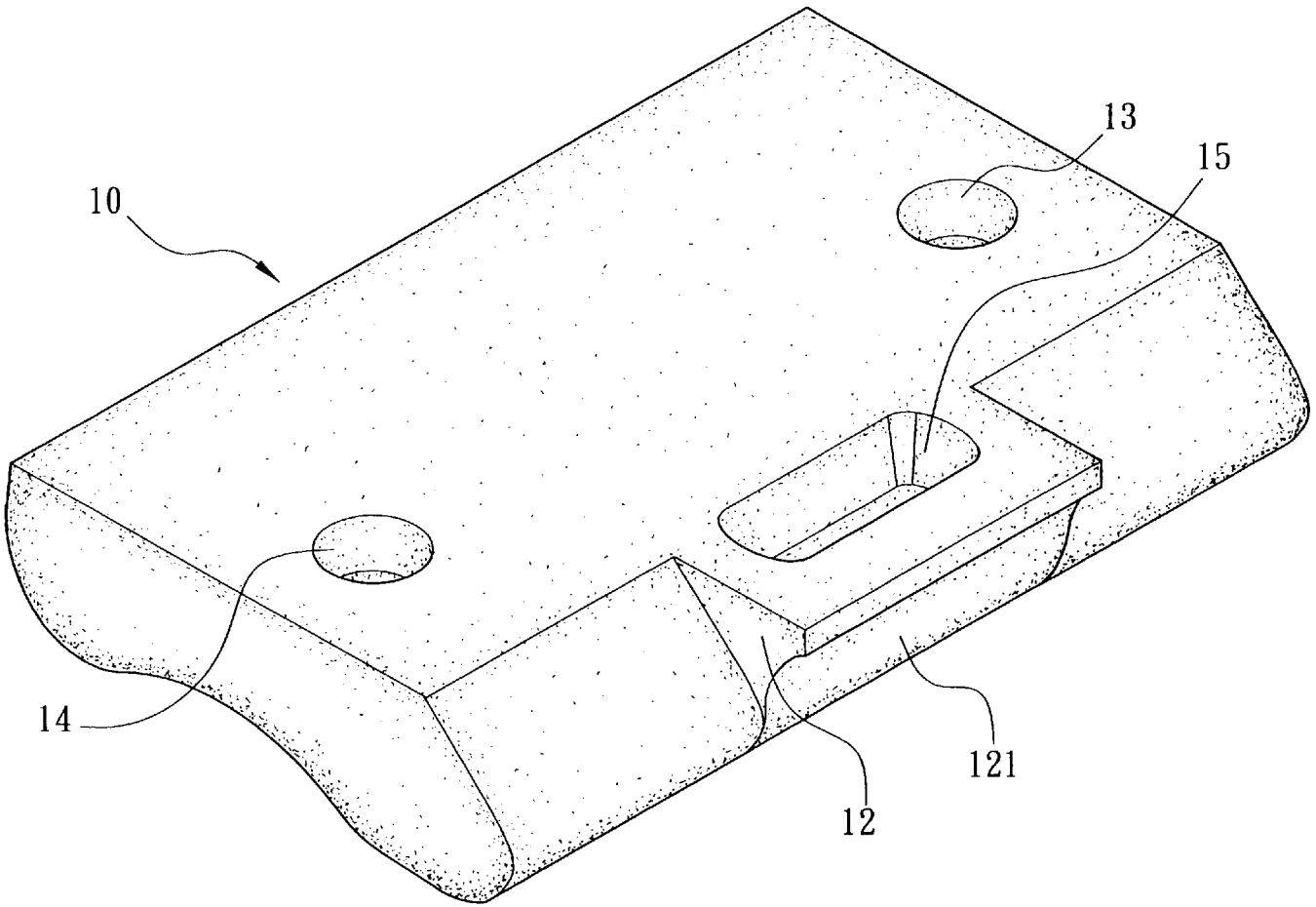
FIG. 2 is a bottom perspective view of FIG. 1.
Figure 4:
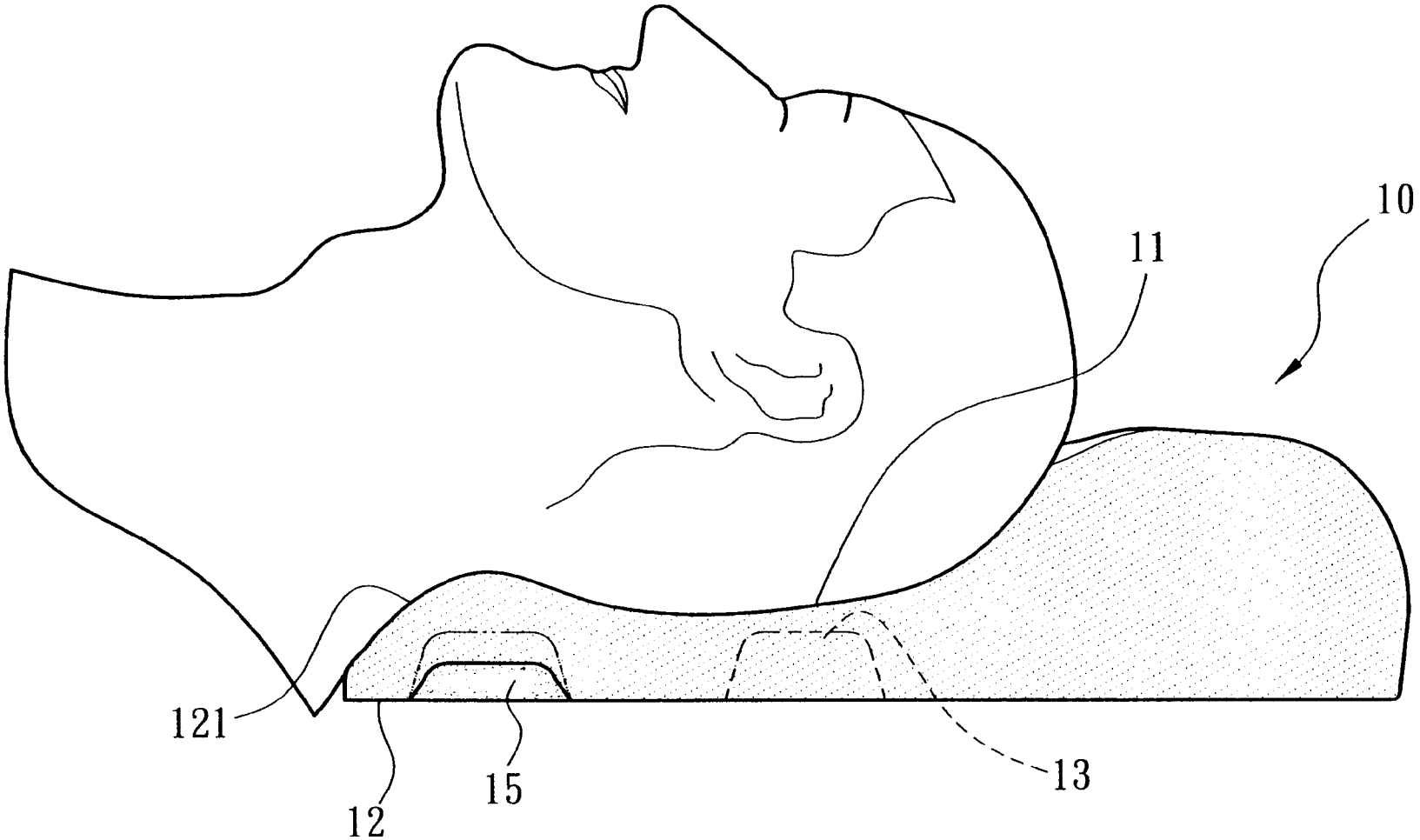
FIG. 4 is a cross-sectional view of either embodiment engaging the back of head of a user and showing a bottom opening having a smaller upper side.
Figure 5:
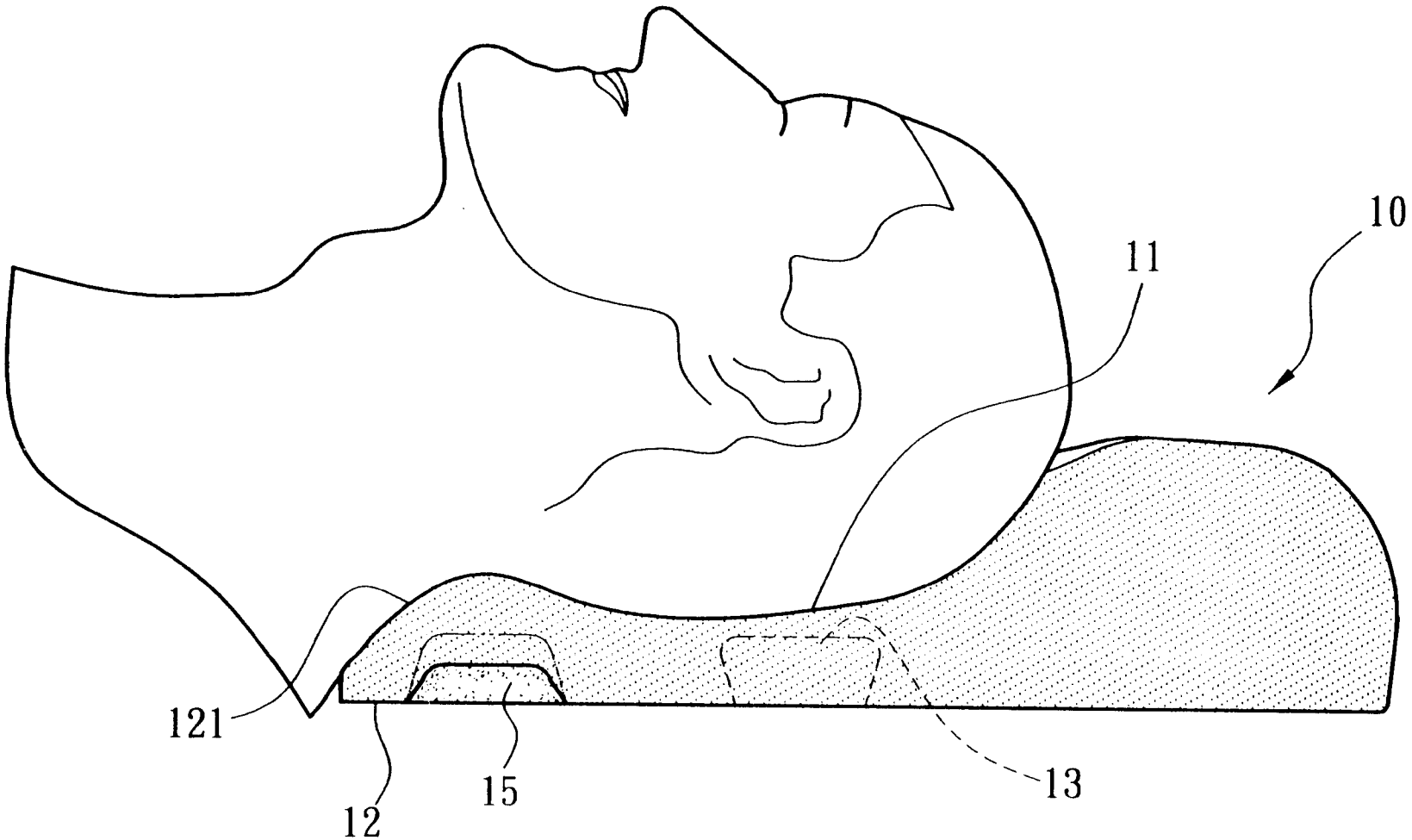
FIG. 5 is another cross-sectional view similar to that of FIG. 4, but showing a bottom opening having a larger upper side.

Moreover, a front lengthwise projection member 12 is extended from bottom of body 10 adjacent to arcuate central recess 11 in which the length of projection member 12 is smaller than that of body 10 (FIGS. 1 and 2). Projection member 12 has a front slant 121 for engaging neck and spine of user as a support in sleeping, as seen in FIGS. 4 and 5. Similarly, when user rotates his or her body and face to either right or left side, shoulder and spine of user can be appropriately supported by body 10 because slope 111 has the highest elevation on top surface of pillow.

Also, body 10 has first, second, and third cavities 13, 14, and 15 on the bottom each having a predetermined depth in which first or second cavity 13 or 14 substantially has a circular edge adjacent to either side and disposed corresponding to either slope 111 and third cavity 15 is at the underside of projection member 12 having an elongate slope, i.e., the same orientation as projection member 12 (FIG. 2). Each of first, second, and third cavities 13, 14, and 15 has either a larger or smaller bottom opening, than its corresponding upper side. The configuration of first and second cavities 13 and 14 can effectively reduce pressure exerted on ear of user in side sleeping as well as increase a flexibility of either slope 111 for providing a degree of comfort to face of user. Further, the configuration of third cavity 15 can effectively reduce pressure exerted on spine of user as well as increase a flexibility of projection member 12 for appropriately supporting head and spine of user in face-up sleeping.

Figure 3:
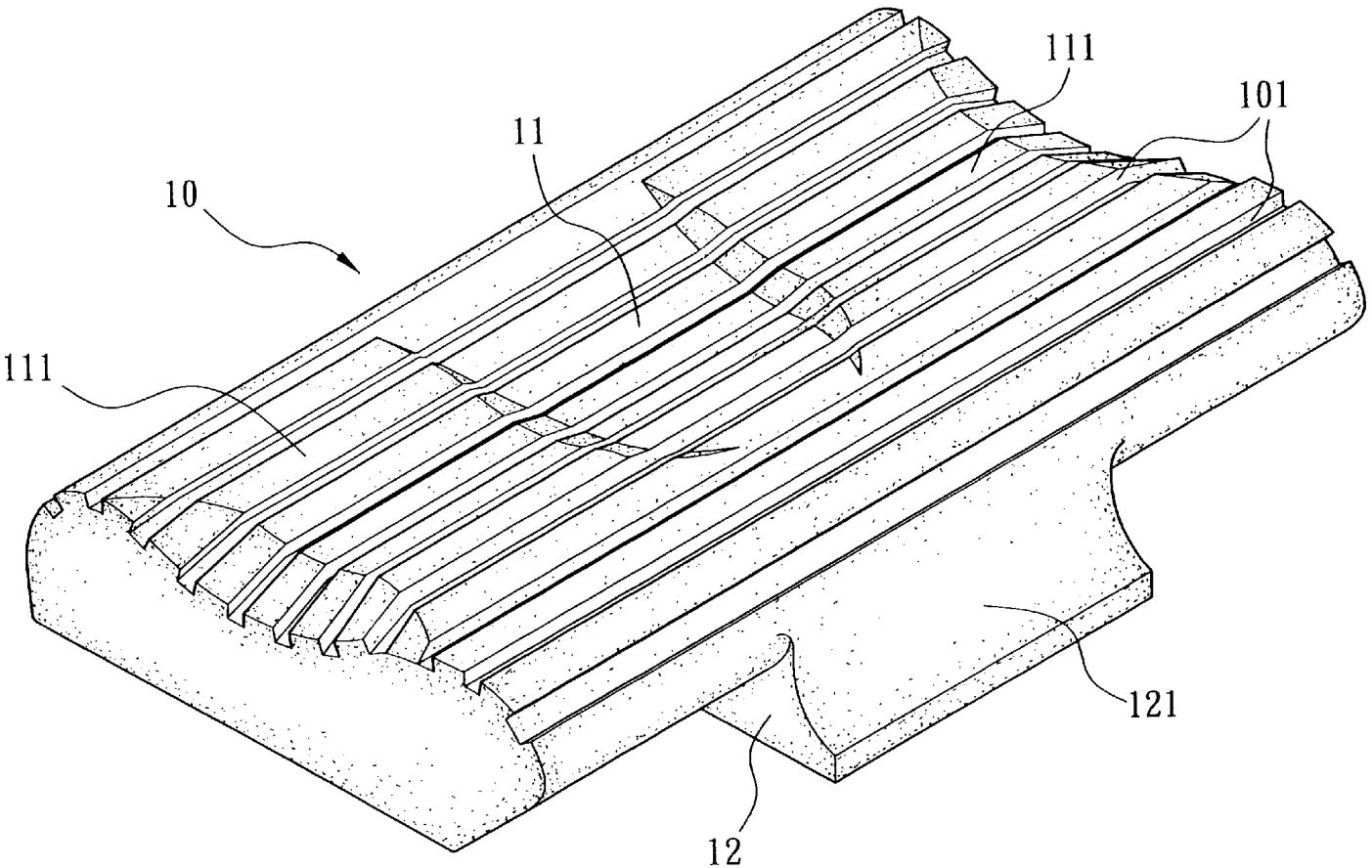
FIG. 3 is a top perspective view of a second preferred embodiment of ergonomic pillow according to the invention.

Referring to FIG. 3, there is shown a second preferred embodiment of ergonomic pillow according to the invention. The difference between first and second preferred embodiments is that a plurality of parallel lengthwise grooves 101 are formed from one side to the other side on top of body 10. The provision of grooves 101 can increase ventilation for providing a degree of comfort to head of user.

In brief, in face-up sleeping, head of user is placed on arcuate central recess 11 and spine thereof engages the front slant 121 of projection member 12, as seen in FIGS. 4 and 5. Hence, the head and the spine of user can be appropriately supported. Also, a degree of comfort is provided to the head and the spine of user. As to side sleeping, one ear of user may press on slope 111 at right or left side so that face, either ear, spine, and either shoulder can be appropriately supported for effectively relaxing head and spine of user.

While the invention has been described by means of specific embodiments, numerous modifications and variations could be made thereto by those skilled in the art without departing from the scope and spirit of the invention set forth in the claims.

What is claimed is:

1. An ergonomic pillow comprising:

a body including an inclined surface at each of a pair of sides, an arcuate central recess, and a slope near each side extended from the inclined surface to the recess so that each slope has the highest elevation on a top surface of the body;

a front lengthwise projection member extended from a bottom of the body adjacent to the recess, the projection member having a front slant;

first and second cavities on the bottom of the body adjacent to either side and disposed corresponding to either slope; and an elongate third cavity at an underside of the projection member having the same orientation as the projection member.

2. The pillow of claim 1, further comprising a plurality of parallel lengthwise grooves extended from one side to the other side on a top of the body for increasing ventilation.

3. The pillow of claim 1 or 2, wherein each of the first, the second, and the third cavities has a predetermined depth and at least one cavity includes an upper side and a bottom opening smaller than the upper side.

4. The pillow of claim 1 or 2, wherein each of the first, the second, and the third cavities has a predetermined depth and at least one cavity includes an upper side and a bottom opening larger than the upper side.

5. The pillow of claim 2, wherein each of the first, the second, and the third cavities has a predetermined depth and includes an upper side and a bottom opening smaller than the upper side.

6. The pillow of claim 2, wherein each of the first, the second, and the third cavities has a predetermined depth and includes an upper side and a bottom opening larger than the upper side.

* * * * *